US006141909A

United States Patent [19]

Hanson

[11] Patent Number: 6,141,909

[45] Date of Patent: Nov. 7, 2000

[54] SAFETY GUARDS FOR DOOR JAMBS

[75] Inventor: Brian R. Hanson, White Bear Lake, Minn.

[73] Assignee: Kreger-Hanson, Incorporated, White Bear Lake, Minn.

[21] Appl. No.: 09/286,233

[22] Filed: Apr. 5, 1999

Related U.S. Application Data

[63] Continuation-in-part of application No. 08/873,061, Jun. 11, 1997, abandoned.

[51] Int. Cl.[7] ..... E06B 3/88; E05D 11/00

[52] U.S. Cl. ..... 49/303; 49/383; 160/40; 16/250

[58] Field of Search ..... 49/303, 383, 486, 49/475; 160/40; 16/250, 251, 225, 137

[56] References Cited

U.S. PATENT DOCUMENTS

| | | | |
|---|---|---|---|
| 474,633 | 5/1892 | Glazier . | |
| 613,592 | 11/1898 | Nagley . | |
| 1,258,856 | 3/1918 | Beaudette . | |
| 1,415,493 | 5/1922 | Strayer . | |
| 1,444,398 | 2/1923 | Shepard . | |
| 1,444,994 | 2/1923 | White . | |
| 1,626,844 | 5/1927 | Kuhn . | |
| 2,015,186 | 9/1935 | Kauzor . | |
| 2,208,198 | 7/1940 | Seaman | 49/383 X |
| 2,284,320 | 5/1942 | Howe | 49/383 X |
| 2,557,716 | 6/1951 | Allee . | |
| 2,641,792 | 6/1953 | Peeler . | |
| 2,681,480 | 6/1954 | Dixon, Sr. . | |
| 2,694,234 | 11/1954 | Roby et al. . | |
| 2,707,812 | 5/1955 | Lewis | 20/69 |
| 2,804,137 | 8/1957 | Couse . | |
| 2,910,741 | 11/1959 | Dettman . | |
| 2,995,285 | 8/1961 | Hallenbeck . | |
| 3,302,690 | 2/1967 | Hurd . | |
| 3,319,697 | 5/1967 | Krohn . | |
| 3,581,884 | 6/1971 | Caldwell . | |
| 3,616,487 | 11/1971 | Dearth . | |
| 3,827,183 | 8/1974 | Zimmerman et al. . | |
| 4,040,142 | 8/1977 | Ippolito . | |
| 4,261,140 | 4/1981 | McLean . | |
| 4,290,233 | 9/1981 | Hubbard . | |
| 4,344,253 | 8/1982 | Stiles . | |
| 4,845,892 | 7/1989 | Pinto . | |

(List continued on next page.)

FOREIGN PATENT DOCUMENTS

| | | | |
|---|---|---|---|
| 2666841 | 9/1990 | France | 49/383 |
| 70707 | 12/1892 | Germany | 49/383 |
| 2 218 449 | 11/1989 | United Kingdom | 49/383 |
| 2221943A | 2/1990 | United Kingdom | 49/383 |
| WO92/15763 | 9/1992 | WIPO | 49/383 |

OTHER PUBLICATIONS

"Fingagard Fitting Instructions", Ofna Baby Products, 2 pages, (Date Unknown).

"Fingersafe MKIA—open hinge protection", Fingersafe Technical Data, 11 pages, Nov. 23, 1998.

"LCN Safety–Guard", Ingersoll Rand Architectural Hardware, 1 page (Date Unknown).

"Lil' Fingers Safety Shields", Lil' Fingers Safety Shields Listing, 2 pages (Date Unknown).

"Safety–Guard", Ingersoll–Rand, Architectural Hardware, 4 pages, ©1995.

*Primary Examiner*—Daniel P. Stodola
*Assistant Examiner*—Khoa Tran
*Attorney, Agent, or Firm*—Merchant & Gould P.C.

[57] ABSTRACT

A protective shield designed for attachment to the door and door jamb for covering a pinch-void area and preventing fingers and other objects from getting pinched when the door closes. The unique geometry of the shield and narrow attachment allows for easy installation on door assemblies with push bars or panic devices. The protective shield is simple in design and thus longer lasting, as well as being aesthetically pleasing. Furthermore, the protective shield allows a relatively large swinging movement of the door, for instance up to 110 degrees, more preferably up to 180 degrees, without any resultant damage to the protective shield, to the door or to the door hardware.

4 Claims, 5 Drawing Sheets

U.S. PATENT DOCUMENTS

| | | | |
|---|---|---|---|
| 4,878,267 | 11/1989 | Roach et al. . | |
| 4,893,666 | 1/1990 | Hormann . | |
| 5,001,862 | 3/1991 | Albenda . | |
| 5,092,077 | 3/1992 | Teinturier et al. . | |
| 5,220,708 | 6/1993 | Lucas et al. . | |
| 5,359,812 | 11/1994 | Matfield . | |
| 5,419,084 | 5/1995 | Sankey et al. . | |
| 5,509,235 | 4/1996 | Chander . | |
| 5,918,800 | 7/1999 | Goshorn et al. | 229/199 |
| 6,001,200 | 12/1999 | Hibler | 156/71 |

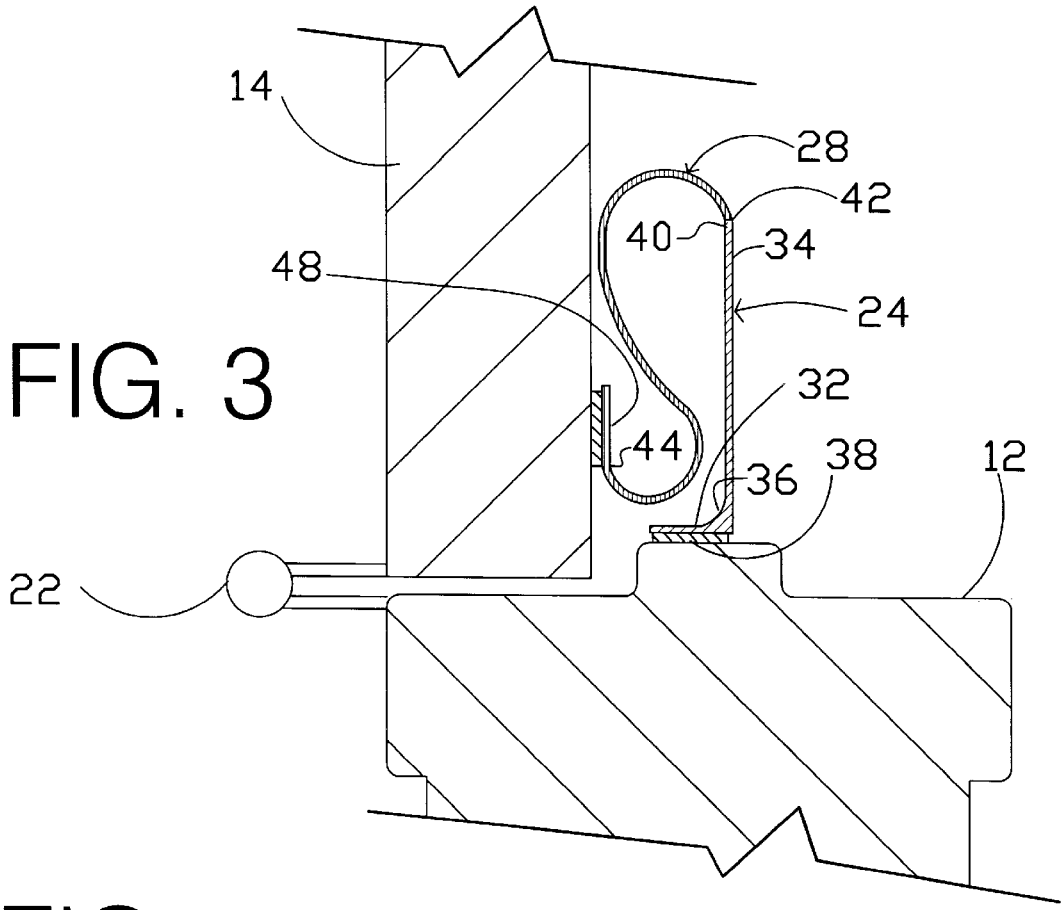
FIG. 3
FIG. 4
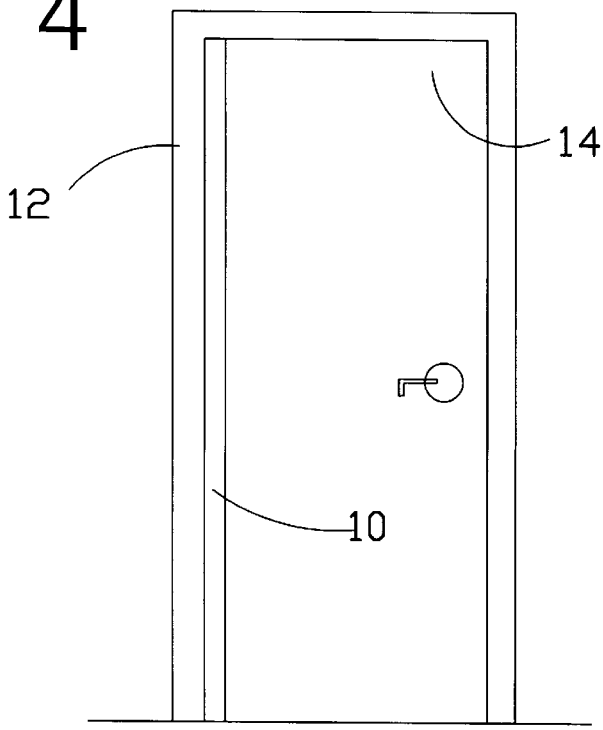

SAFETY GUARDS FOR DOOR JAMBS

This is a continuation-in-part of application Ser. No. 08/873,061, filed on Jun. 11, 1997, and now abandoned.

SUMMARY OF THE INVENTION

The invention relates to a shield device that when properly mounted covers the space between a door jamb or frame and a door to prevent fingers or other objects from being clamped, trapped or pinched within the space when the door closes.

BACKGROUND OF THE INVENTION

Doors are commonly mounted by hinges to a door jamb or frame to allow the door to swing between open and closed positions. In the open position of the door, a gap is formed between the hinged edge of the door and the door jamb. This gap closes when the door is moved to the closed position, creating a dangerous pinching area that can cause serious injury to fingers or other body parts caught within the closing gap, as well as potentially causing damage to other objects caught within the closing gap. Finger injuries that result from fingers getting caught within the gap are especially troublesome, as the forces generated by the closing door are quite substantial, and can often times result in the crushing of the finger(s), or even severing of the finger(s) from the hand. Children are especially prone to such injuries as their relatively small fingers and hands can easily fit into the gap.

Numerous prior art devices are known for trying to prevent fingers and other objects from getting caught within the gap between the hinge edge of a door and the door jamb. These devices include U.S. Pat. No. 5,419,084 which discloses a finger guard designed with multiple leafs and numerous "living" hinges. Due to the relatively large number of leafs and "living" hinges, manufacturing of the shield is difficult and the chances for failure of one of the "living" hinges is increased. U.S. Pat. No. 4,878,267 discloses a shield device that is intended to be placed within the gap. However, this device will not work with many existing doors and may cause door hardware (e.g. hinges, door closers and door stops) to bend and/or otherwise be damaged. U.S. Pat. No. 5,419,084 teaches the use of four strips to create a "web" that retains sufficient resilience to shield the gap from fingers while closing the door, as well as teaching the use of further strips to secure the four strips to the door and frame.

However, none of the prior art devices will work with panic push bar exit devices, or on doors that open a full 180 degrees. Furthermore, many conventional shield devices create a force on the door that tend to resist the opening and closing movements of the door thereby making door movement difficult and possibly resulting in damage to the door and/or door hardware. Conventional shield devices also tend to have a relatively large number of hinges, which increases the potential for a failure of one of the hinges. Thus, a shield device should be designed to have as few hinges as possible in order to reduce the chance of failure of the device.

U.S. Pat. No. 5,220,708 to Lucas et al. discloses a self-trimming shield device that is designed to neatly fold against the door so as to preserve the appearance of the door trim. This device, however, limits the extent to which the door can swing open, since contact between the hinge edge of the door and the shield, which occurs when the door swings past a certain point, will likely cause damage to the shield device.

There is a need for an improved protective shield for covering a pinch-void area defined by a door jamb and a door, and that can work on all door swings up to 180 degrees, as well as working with door push bar devices, and which is simple in design to reduce the chance of failure.

SUMMARY OF THE INVENTION

The invention provides an improved protective shield designed for attachment to the door and door jamb for covering the pinch-void area and preventing fingers and other objects from getting pinched when the door closes. The protective shield of the invention is simple in design, as well as being aesthetically pleasing. Furthermore, the protective shield of the invention allows a relatively large swinging movement of the door, for instance up to 110 degrees, more preferably up to 180 degrees, without any resultant damage to the protective shield and without resisting opening or closing movements of the door.

In one embodiment in accordance with the invention, a protective shield for covering a pinch-void area defined by a door jamb and a door comprises a substantially rigid first foot piece that includes a generally planar first foot portion and a generally planar second foot portion rigidly connected to the first foot portion at generally a right angle thereto. The second foot portion includes an edge spaced from the first foot portion, and a flexible diaphragm having first and second edges is also provided, with the first edge being attached to the edge of the second foot portion.

By using a flexible diaphragm attached directly to the rigid foot piece, a relatively simple shield construction is obtained which is long lasting and durable. Furthermore, by carefully selecting the diaphragm length and the length of the second foot portion, the protective shield can permit a door swing of up to 110 degrees without causing damage to the shield, and the diaphragm can be prevented from being pushed into the pinch void area.

In another embodiment in accordance with the invention, a protective shield for covering a pinch-void area defined by a door jamb and a door is provided which includes a substantially rigid first foot piece with a generally planar first foot portion and a generally planar second foot portion rigidly connected to the first foot portion at generally a right angle thereto. The second foot portion includes an edge spaced from the first foot portion. The shield also includes a second foot piece, and a shield piece is interconnected between the first foot piece and the second foot piece. The shield piece includes first and second rigid panels having adjacent edges and respective opposite edges. A plurality of flexible hinges connect the adjacent edges of the first and second rigid panels and connect the opposite edges of the first and second panels to the edge of the second foot portion and to the second foot piece, respectively.

This embodiment is particularly useful when a door swing of up to 180 degrees is desired, in which case the first foot portion is connected to the door and the second foot piece is connected to the door jamb, and the first foot portion is attached to the door at a predetermined distance from a hinge edge corner of the door, and the second foot portion has a length that is between about two to three times the predetermined distance.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

FIG. 3 is a view similar to FIG. 1, but showing an alternate arrangement of the protective shield.

FIG. 4 is an elevational view of the door and door frame, showing the shield device extending substantially the entire height of the door.

DETAILED DESCRIPTION OF THE PREFERRED EMBODIMENT

Figure 1:
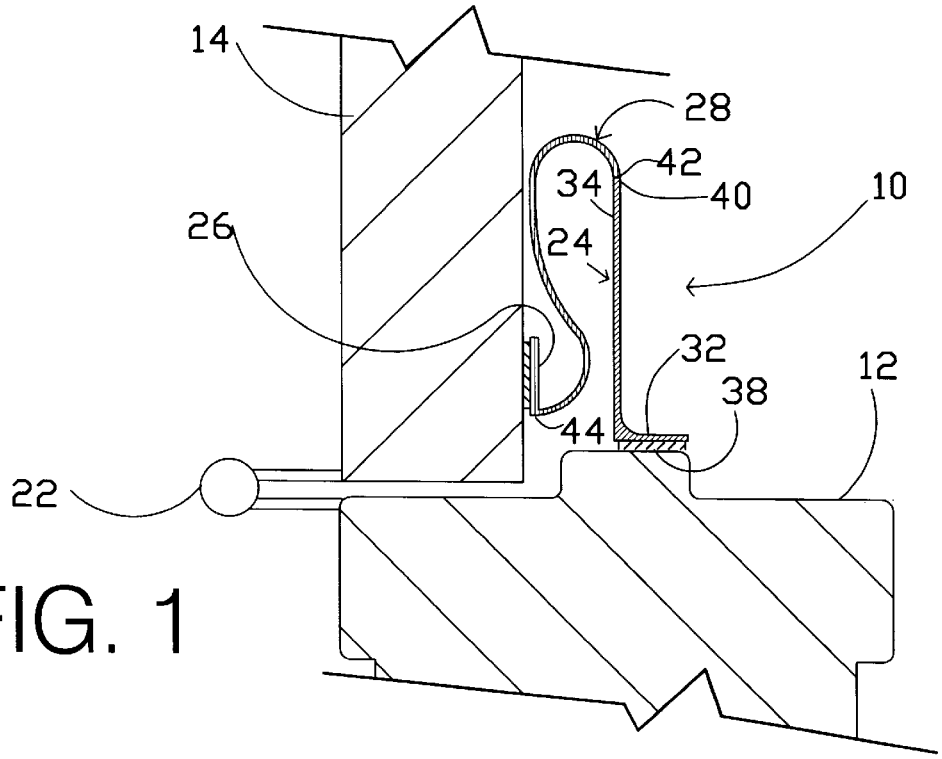
FIG. 1 is a cross-sectional view of a protective shield in accordance with one embodiment of the invention attached to a doorjamb and door, with the door in its closed position.

The invention pertains to a protective shield that is affixed at one edge to a door and affixed at a second edge to a door jamb or frame so as to cover a pinch void area between the hinge edge of the door and the door jamb, and thereby prevent fingers and other objects from getting pinched between the hinge edge of the door and the door jamb when the door closes. The protective shield in accordance with the present invention is designed to permit the door to swing greater than 90 degrees from the closed position to the open position, with causing damage or destruction to the protective shield, to the door and to door hardware such as hinges, door closers and door stops.

In one version, the protective shield includes a rigid, L-shaped foot piece that is preferably attached to the door jamb. One edge of a shield piece in the form of a flexible diaphragm is fixed to the end of the foot piece, while the opposite end of the diaphragm is connected to the door. The foot piece and diaphragm are designed such that when the door is swung to its open position, the diaphragm is prevented from being pushed into the pinch void area between the hinge edge of the door and the door jamb. Furthermore, the design of the foot piece and diaphragm are such that when the door is swung to its closed position, the diaphragm is neatly rolled into generally an S-shape against the face of the door. In addition, the protective shield permits the door to swing up to 110 degrees to its open position without causing damage to the shield.

In another version, the protective shield includes a rigid, L-shaped foot piece attached to the face of the door adjacent the hinge edge thereof. A shield piece composed of a plurality of generally rigid panels is designed to cover the pinch void area between the hinge edge of the door and the door jamb, with one edge of the shield piece being hingedly attached to the foot piece and the opposite edge of the shield piece being connected to the door jamb. The foot piece and shield piece are specifically designed to permit 180 degree swinging movements of the door between its closed and open positions, without damaging the shield and with the shield piece remaining in place to prevent access to the pinch void area.

With reference to FIGS. 1–4, a first embodiment of a protective shield in accordance with the principles of the invention is referenced by the numeral 10. The shield 10 is designed to be attached between a door jamb or frame 12 and a door 14 so as to cover a pinch void area 16, defined as the area between a hinge edge 18 of the door 14, an inner surface 20 of the door jamb 12, and a swing arc of the door illustrated by dashed line A. The door 14 is connected to the door jamb 12 by a plurality of hinges 22 (only one hinge being shown in the figures), to allow the door 14 to swing between a closed position, shown in FIG. 1 and an open position, shown in FIG. 2. As shown in FIG. 4, the shield 10 extends substantially the entire height of the door 14 so as to cover the entire length of the pinch void area 16. However, it is to be realized that the shield 10 could be designed to cover only a portion of the pinch void area, e.g. the pinch void area at the bottom half of the door 14, depending upon the expected size and reach of children who may be around the door.

Figure 2:
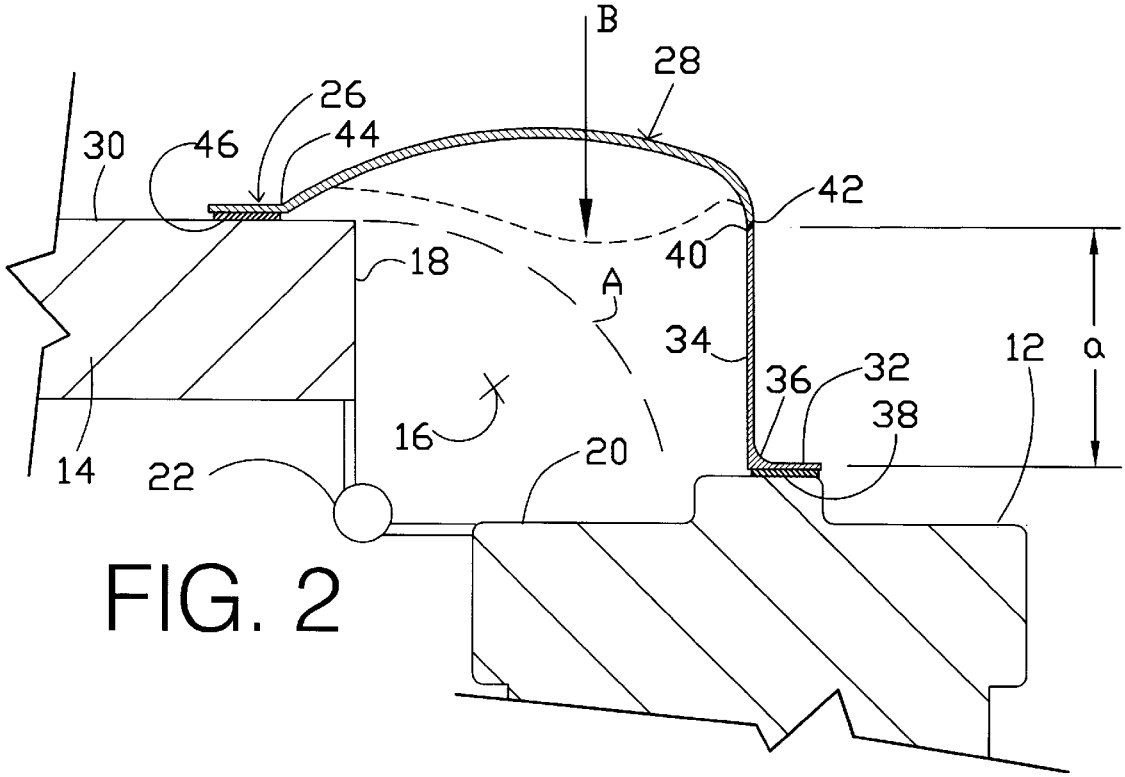
FIG. 2 is a cross-sectional view similar to FIG. 1, but with the door in its open position.

The pinch void area 16 is defined when the door is open, as shown in FIG. 2. When the door moves toward the closed position in FIG. 1, the pinch void area 16 starts to rapidly reduce in area, thereby creating a dangerous pinching area that can cause serious injury to fingers caught within the pinch void area 16. The protective shield 10 is specifically designed to prevent entry of fingers and other objects into the pinch void area, thereby preventing injury and damage when the door is swung to its closed position.

The protective shield 10 includes an L-shaped, rigid first foot piece 24, a second foot piece 26, and a flexible diaphragm shield piece 28 interconnected between the first foot piece 24 and the second foot piece 26. The first foot piece 24 is connected to the inner surface 20 of the door jamb 12 and the second foot piece 26 is connected to a surface 30 of the door 14 adjacent the hinge edge 18 thereof, whereby the flexible diaphragm 28 is disposed over and covers the pinch void area 16 when the door 14 is open.

The first foot piece 24 is defined by a generally planar first foot portion 32 and a generally planar second foot portion 34. The second foot portion 34 is rigidly connected to the first foot portion 32 at a substantially right angle thereto, with a fillet 36 being provided at the juncture thereof, thereby providing the first foot piece 24 a generally L-shape. The first foot piece 24 is preferably made from a rigid plastic material, such that the L-shape of the foot piece 24, i.e. the right angle between the foot portion 32 and the foot portion 34, is maintained under normal operating conditions. It is to be realized that the first foot piece 24 could be made from materials other than plastic, such as metal or wood.

The first foot portion 32 is suitably fastened to the inner surface 20 of the door jamb 12 such that the second foot portion 34 is oriented perpendicularly to the inner surface 20. In the embodiment illustrated in FIGS. 1–2, the first foot portion 32 is fastened to the inner surface 20 by double sided adhesive foam tape 38. However, it is to be realized that other forms of attachment could be used, such as glue, nails, screws, etc. Furthermore, the fillet 36 is oriented such that it faces away from the surface 30 of the door 14. However, as shown in FIG. 3, the foot piece 24 could alternatively be mounted such that the fillet 36 faces toward the surface 30 of the door 14.

The second foot portion 34 includes an edge 40 that is remote from the first foot portion 32, and to which an edge 42 of the flexible diaphragm 28 is integrally attached. The flexible diaphragm 28 is formed by a single leaf made from a flexible plastic material, such as vinyl, or rubber material, whereby the diaphragm 28 is soft and elastically flexible. The diaphragm preferably has a Shore A hardness of between about 50–80. The edge 42 of the diaphragm 28 is preferably co-extruded to the edge 40 of the foot portion 34, such that the diaphragm 28 is securely connected to the foot portion 34 and the juncture of the edges 40, 42 form a hinge whereby the diaphragm 28 can pivot or flex relative to the rigid foot portion 34.

The diaphragm 28 further includes an edge 44 opposite the edge 42 which is attached to the second foot piece 26. The edge 44 of the diaphragm 28 is preferably co-extruded to the foot piece 26, such that the diaphragm 28 is securely connected to the foot piece 26 and the juncture therebetween forms a hinge whereby the diaphragm 28 can pivot or flex relative to the foot piece 26. Like the foot piece 24, the foot piece 26 can be attached to the surface 30 of the door 14 using double sided adhesive foam tape 46, however other forms of attachment, such as glue, nails, screws, etc. could be used if desired.

By co-extruding the edges 42, 44 of the diaphragm 28 to the foot pieces 24, 26, respectively, the diaphragm is hingedly attached to the foot pieces and can thereby pivot and flex relative thereto. The relatively large length of the joints between the edges 42, 44 and the foot pieces 24, 26, and the hinges formed therebetween, spreads the bending stresses out over a larger surface, thereby resulting in a shield 10 that will last for more bending cycles than prior art shield devices. If desired, the plastic material forming the diaphragm 28 and the foot pieces 24, 26 can be colored to match the door jamb 12 and door 14, or colored to match other building components and decor.

Instead of using the foot piece 26, the diaphragm 28 could be directly connected to the surface 30 of the door 14, such as by the double sided tape 46, as shown in FIG. 3. In this arrangement, the diaphragm 28 would be lengthened beyond the edge 44 shown in FIGS. 1 and 2 to provide a portion 48 that can be attached to the surface 30. The portion 48 could have any desired length to enable the installer of the shield to trim off unneeded length, if necessary. The elimination of the foot piece 26, as well as orienting the fillet 36 toward the surface 30 of the door 14, provide a simpler, more aesthetic appearance for the protective shield.

With reference to FIG. 2, it is seen that the application of a force B to the diaphragm 28 can cause the diaphragm to deflect toward the pinch void area 16, as illustrated in dashed lines. It is preferred that the protective shield 10 be designed such that the diaphragm 28 cannot be pushed down into the pinch void area 16 which could result in fingers getting pinched in the pinch void area 16 and/or result in the diaphragm being pinched within the area 16 which could result in the diaphragm being damaged. The protective shield must also be designed to permit a relatively large amount of swinging movement of the door between the open and closed positions, without causing destruction of the protective shield as a result of contact between the door jamb and/or door and the protective shield.

To prevent the diaphragm 28 from being pushed downward into the area 16, as well as permitting a relatively large amount of swinging movement of the door 14 without causing destruction of the protective shield 10, a specific relationship between the length of the diaphragm 28 and the length a of the second foot portion 34 should be maintained. The length of the diaphragm 28 is the length of the diaphragm between the edge 42 and the edge 44, while the length a is defined as the length of the foot portion 34 from the foot portion 32 to the edge 40.

To prevent deflection of the diaphragm 28 into the pinch void area 16 and to permit a maximum swinging movement of the door 14 without destructive contact with any portion of the protective shield 10, the length a should be about ½ of the length of the diaphragm 28. Using this relationship, the diaphragm 28 is prevented from being pushed into the pinch void area 16 by the force B. Moreover, this relationship permits a door swing of up to about 110° from the closed position to the open position, thereby increasing the extent to which the door can be opened.

As illustrated in FIGS. 1 and 3, when the door 14 is closed, the diaphragm 28 is neatly rolled up into an S-shape, thereby preserving the appearance of the door assembly. When the door is pivoted to the open position, the diaphragm forms a generally outwardly extending convex shape to cover the pinch void area 16 and minimize the chance of fingers or other objects from being pinched when the door swings back to the closed position.

Another version of a protective shield 100 in accordance with the invention is illustrated in FIGS. 5–8, with elements corresponding to elements shown in FIGS. 1–4 being referenced by the same reference numbers. The shield 100 is designed to permit 180 degree swinging movements of the door 14 between its closed position shown in FIG. 5 and its fully open position shown in FIG. 7, with the shield 100 remaining in place to prevent access to the pinch void area 16. The shield 100 is also designed for use with a door 14 having a push bar or panic exit device 102 connected to the surface 30 thereof, such that interaction between the shield 100 and the push bar 102 is avoided. Moreover, like the shield 10, the shield 100 can extend substantially the entire height of the door 14 so as to cover the entire length of the pinch void area 16, or the shield 100 could be sized to cover only a portion of the length of the pinch void area.

The shield 100 includes an L-shaped, rigid first foot piece 104, a second foot piece 106, and a shield piece 108 interconnected between the first foot piece 104 and the second foot piece 106. The first foot piece 104 is connected to the surface 30 of the door 14 adjacent the hinge edge 18 thereof, while the second foot piece 106 is connected to the inner surface 20 of the doorjamb 12, whereby the shield piece 108 is disposed over and covers the pinch void area 16 when the door 14 is open.

The first foot piece 104 is defined by a generally planar first foot portion 110 and a generally planar second foot portion 112. The second foot portion 112 is rigidly connected to the first foot portion 110 at a substantially right angle thereto, with a fillet 114 being provided at the juncture thereof, thereby providing the first foot piece 104 a generally L-shape. The first foot piece 104 is preferably made from a rigid plastic material, such as polyvinyl chloride, whereby the L-shape of the foot piece 104, i.e. the right angle between the foot portion 110 and the foot portion 112, is maintained under normal operating conditions. It is to be realized that the first foot piece 104 could be made from materials other than plastic, such as metal or wood.

The first foot portion 110 is suitably fastened to the surface 30 of the door 14 such that the second foot portion 112 is oriented perpendicularly to the surface 30. Furthermore, as in the embodiment illustrated in FIGS. 1–2, double sided adhesive foam tape is preferably used to secure the foot piece 104 to the door 14, however other forms of attachment, such as glue, nails, screws, etc., could be used in place of the tape. Similarly, the second foot piece 106 is secured to the inner surface 20 of the door jamb 12 using double sided adhesive foam tape, glue, nails, screws, etc. The foot piece 106 is also made from a rigid plastic material, such as polyvinyl chloride.

The shield piece 108 is interconnected between the foot pieces 104, 106, and is composed of a pair of panels 116, 118 made from a rigid plastic material, such as polyvinyl chloride. One edge of the panel 116 is connected by a hinge 120*a* to an end 122 of the foot portion 112, while one edge of the panel 118 is connected by a similar hinge 120*b* to the foot piece 106, with adjacent edges of the panels 116, 118 being connected together by a hinge 120*c*. The hinges 120*a–c* enable relative movements between the rigid panels 116, 118 and the rigid foot pieces foot pieces 104, 106 as the door 14 is swung between the open and closed positions shown in FIGS. 5–7.

Figure 8:
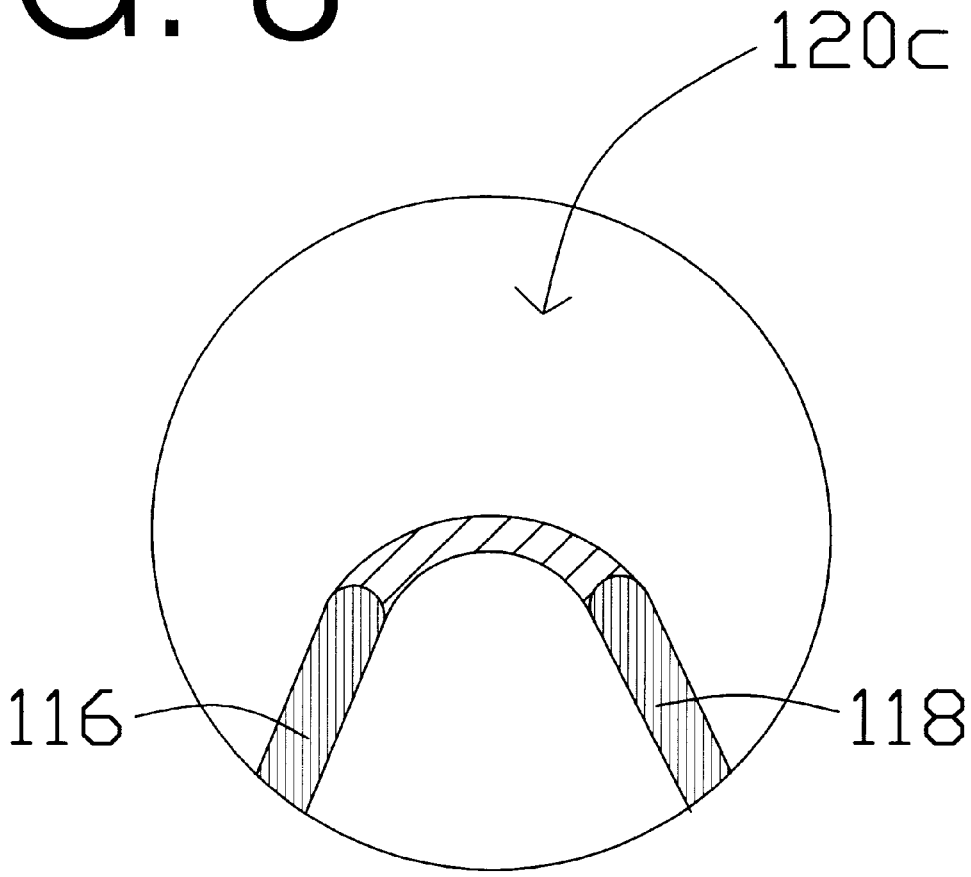
FIG. 8 is a detailed view of a hinge between two of the panels in the shield of FIGS. 5–7.

FIG. 8 illustrates in detail the construction of the hinge 120*c*. The hinges 120*a*, 120*b* have the same construction as the hinge 120*c* and are not separately described herein. As shown, the adjacent edges of the panels 116, 118 are rounded and a flexible plastic or rubber material forming the hinge 120*c* is interconnected between the edges of the panels 116, 118 to permit pivoting and other relative movement between the two panels 116, 118. Suitable plastic and rubber materials for forming the hinge 120*c* include thermoplastics such as Alcryn® Santoprene® or polyurethanes. It is preferred that the material forming the hinges have a Shore A hardness of between about 40–80. In one version, the panels could have a thickness between about 0.030 inches to 0.060 inches, while the thickness of the hinge 120*c* could be about 0.025 inches to 0.035 inches. It is to be realized that other hinge materials having different Shore A hardness values could be used. Furthermore, the panels and hinges could have other thicknesses than those described herein.

Figure 5:
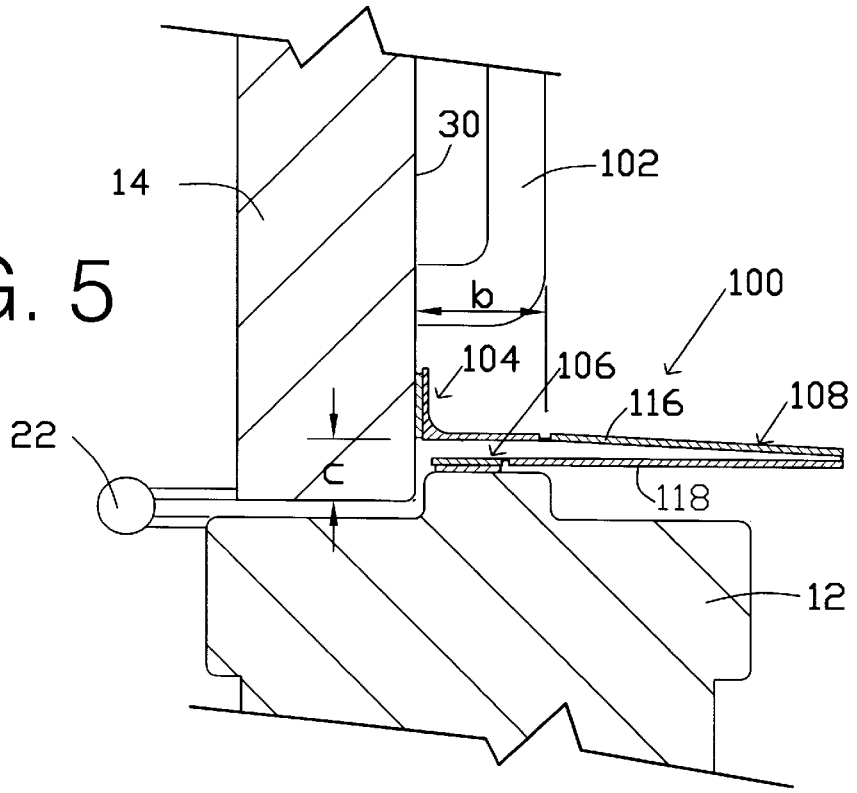
FIG. 5 is a cross-sectional view of a protective shield in accordance with a second embodiment of the invention attached to a door jamb and door, with the door in its closed position.
Figure 6:
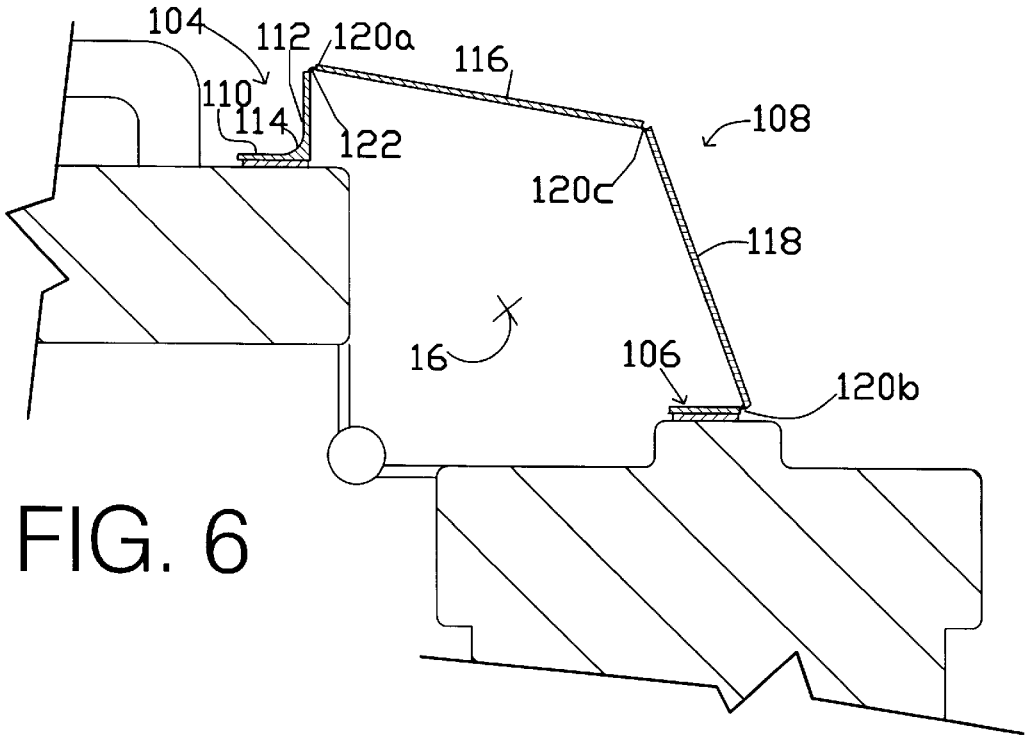
FIG. 6 is a view similar to FIG. 5, but with the door in a partially open position.

As shown in FIG. 5, when the door 14 is closed, the two panels 116, 118 lie generally parallel to each other in a folded condition and are oriented generally perpendicular to the surface 30 of the door 14. As the door 14 starts to swing open about the hinges 22, as shown in FIG. 6, the hinges 120*a–c* enable the panels 116, 118 to unfold while remaining in position over the pinch void area 16. Movement of the door 14 to its fully open position, shown in FIG. 7, continues the unfolding of the panels with the panels remaining in covering position over the pinch void area.

Figure 7:
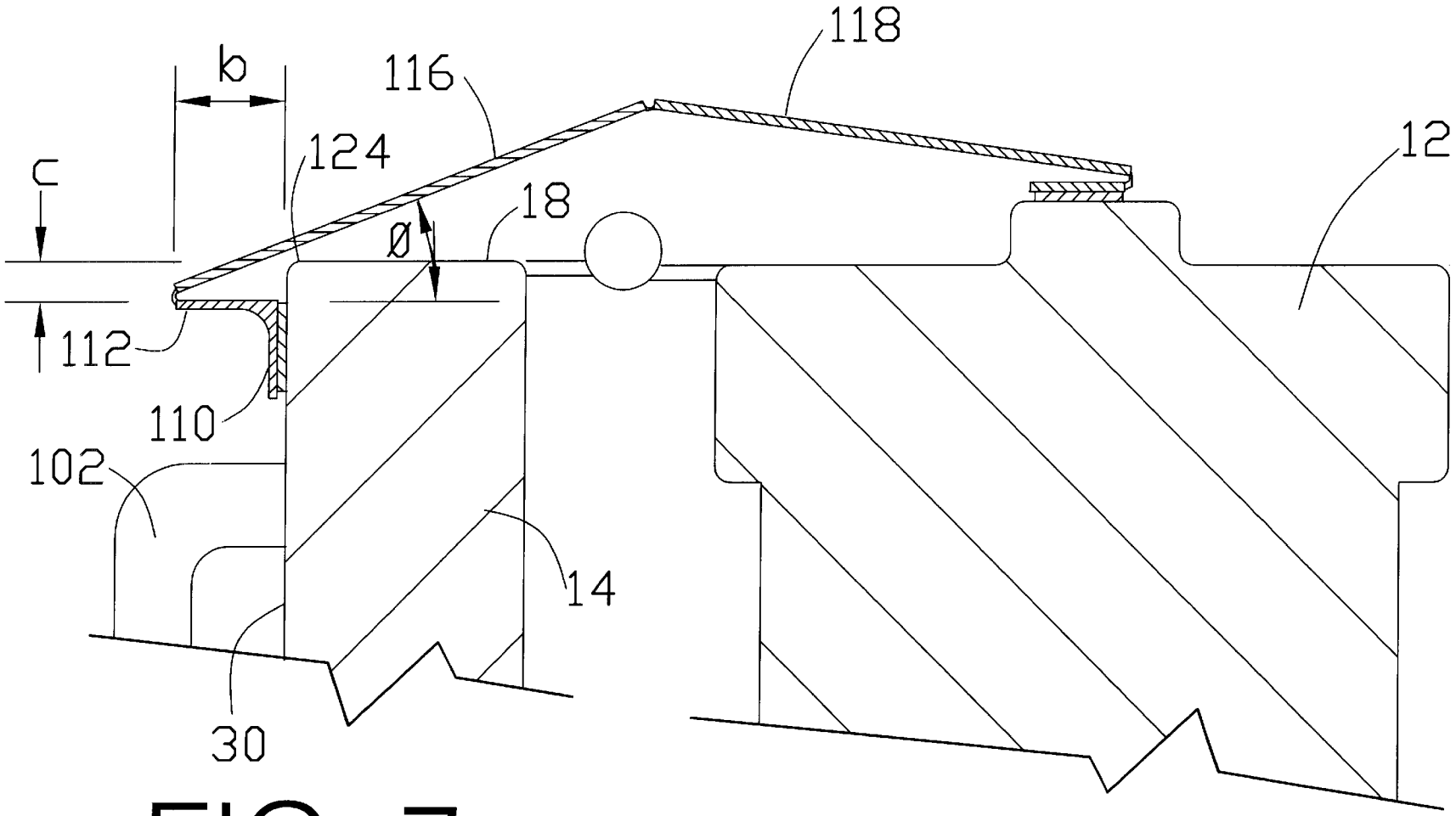
FIG. 7 is a view similar to FIG. 5, but with the door swung 180 degrees to its fully open position.

As evident from FIG. 7, the shield 100 must be designed to prevent contact between the corner 124 of the door 14 at the juncture of the hinge edge 18 and the surface 30 and the panel 116, to enable the door 14 to swing 180 degrees to its fully open position. If the panel 116 does contact the corner 124 before the door reaches the 180 degree position, the panel 116 would be bent around the corner 124, which would damage the panel 116 and potentially cause the panel 116 to be separated from the foot piece 104.

As shown in FIG. 7, the two factors controlling whether contact occurs is the length b of the second foot portion 112 and the distance c of the base of the foot portion 112 from the corner 124. By suitably choosing the variables b and c, contact between the panel 116 and the corner 124 can be avoided. In particular, the inventor has discovered that the length b of the foot portion 112 should be between about 2 to 3 times the distance c, in order to permit the door to swing 180 degrees while avoiding destructive contact between the panel 116 and the corner 124 of the door. This proportion between b and c will result in an angle Ø of between 15 to 35 degrees.

As in the previous embodiment, the foot piece 104 could be reversed if desired such that the fillet 114 faces toward the panel 116. In this case, the distance c would be increased by the length of the foot portion 110 and the length b would have to be correspondingly increased.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A protective shield for covering a pinch-void area defined by a door jamb and a door, comprising:

a substantially rigid first foot piece, said first foot piece including a generally planar first foot portion and a generally planar second foot portion rigidly connected to the first foot portion at generally a rigid right angle thereto, and said second foot portion including an edge spaced from said first foot portion;

a second foot piece;

a shield piece interconnected between the first foot piece and the second foot piece, said shield piece including first and second rigid panels having adjacent edges and first and second opposite edges; and a first hinge connecting the adjacent edges of the first and second rigid panels, a second hinge connecting the first opposite edge to the second foot piece, and a third hinge connecting the second opposite edge to the edge of the second foot portion whereby said third hinge is located at the edge of the second foot portion and said third hinge is spaced from said first foot portion by a predetermined distance that is substantially equal to the length of the second foot portion; and wherein when the protective shield is mounted with the first foot portion of the first foot piece connected to the door and the second foot piece connected to the door jamb, the third hinge is spaced from the door the predetermined distance that is sufficient to permit a 180° door swing without bending the first and second rigid panels.

2. The protective shield according to claim 1, wherein said first foot piece, said second foot piece and said first and second panels are constructed from a rigid plastic material.

3. The protective shield according to claim 2, wherein said first second and third flexible hinges are made from a flexible plastic or rubber material.

4. The protective shield according to claim 1, wherein when said first foot portion is attached to the door at a second predetermined distance from a hinge edge corner of the door, said second foot portion has a length that is between 2 to 3 times the second predetermined distance.

* * * * *